US008978313B1

(12) United States Patent
Pilla

(10) Patent No.: US 8,978,313 B1
(45) Date of Patent: Mar. 17, 2015

(54) PRECIPITATION DEFLECTOR

(71) Applicant: Antonio Pilla, Novelty, OH (US)

(72) Inventor: Antonio Pilla, Novelty, OH (US)

( * ) Notice: Subject to any disclaimer, the term of this patent is extended or adjusted under 35 U.S.C. 154(b) by 0 days.

(21) Appl. No.: 14/245,511

(22) Filed: Apr. 4, 2014

(51) Int. Cl.
*E04B 7/16* (2006.01)
*E04D 13/064* (2006.01)
*E04F 10/08* (2006.01)

(52) U.S. Cl.
CPC . *E04B 7/163* (2013.01); *E04B 7/16* (2013.01); *E04D 13/064* (2013.01); *E04F 10/08* (2013.01)
USPC ..... 52/11

(58) Field of Classification Search
CPC ..... E04F 10/08; E06B 9/32; E06B 9/02; E06B 9/68; E06B 9/322; E06B 9/6809; E06B 9/74; E06B 2009/689
USPC ..... 52/11, 13, 173.1, DIG. 4; 74/5.46; 335/253; 318/16, 116
See application file for complete search history.

(56) References Cited

U.S. PATENT DOCUMENTS

| | | | | | |
|---|---|---|---|---|---|
| 104,142 | A | | 6/1870 | Hall | |
| 205,064 | A | * | 6/1878 | Doolittle | 49/90.1 |
| 1,098,738 | A | | 6/1914 | Kretzer | |
| 1,343,461 | A | | 6/1920 | Marberg | |
| 2,952,049 | A | * | 9/1960 | Vetere | 49/87.1 |
| 3,164,929 | A | | 1/1965 | Boddie | |
| 3,384,147 | A | * | 5/1968 | Smith | 160/107 |
| 3,387,188 | A | * | 6/1968 | Euler | 361/156 |
| 3,516,086 | A | * | 6/1970 | Aiken | 340/815.88 |
| 3,648,281 | A | * | 3/1972 | Dahms et al. | 340/815.62 |
| 3,772,623 | A | * | 11/1973 | Nordin | 335/253 |
| 3,924,226 | A | * | 12/1975 | Lacy et al. | 345/111 |
| 4,194,189 | A | * | 3/1980 | Lewiner et al. | 340/815.83 |
| 4,329,594 | A | * | 5/1982 | Bohm | 307/10.1 |
| 4,527,355 | A | * | 7/1985 | Numakami et al. | 49/82.1 |
| 4,564,836 | A | * | 1/1986 | Vuilleumier et al. | 345/85 |
| 4,730,633 | A | | 3/1988 | Greenbaum | |
| 4,751,800 | A | * | 6/1988 | Kida et al. | 52/66 |
| 4,926,599 | A | * | 5/1990 | Scholz | 49/87.1 |
| 5,655,335 | A | | 8/1997 | Vermeer | |
| 5,850,861 | A | * | 12/1998 | Silverberg | 160/107 |
| 6,648,050 | B1 | * | 11/2003 | Toti | 160/170 |
| 6,690,350 | B2 | * | 2/2004 | Sheridon | 345/107 |
| 6,897,848 | B2 | * | 5/2005 | Sheridon | 345/107 |
| 8,024,891 | B2 | * | 9/2011 | Maria Ruiter | 47/17 |
| 2006/0261265 | A1 | | 11/2006 | Ray et al. | |
| 2010/0050544 | A1 | * | 3/2010 | Ruiter | 52/173.3 |
| 2010/0178139 | A1 | | 7/2010 | Sundar et al. | |
| 2013/0106144 | A1 | * | 5/2013 | Nagase et al. | 296/223 |
| 2013/0291438 | A1 | * | 11/2013 | Selzer | 49/82.1 |
| 2014/0175240 | A1 | * | 6/2014 | Selzer | 248/237 |

FOREIGN PATENT DOCUMENTS

| | | | | | |
|---|---|---|---|---|---|
| JP | 10058976 | A | * | 3/1998 | B60J 5/04 |
| JP | 10299153 | A | * | 11/1998 | E04B 7/08 |

* cited by examiner

*Primary Examiner* — Brent W Herring
(74) *Attorney, Agent, or Firm* — Pearne & Gordon LLP

(57) ABSTRACT

A roofing apparatus for deflecting precipitation comprises a first roofing panel movable between a retracted position and an extended position. The roofing apparatus further comprises an electrostatic charging device configured to selectively apply an electrostatic force to the first roofing panel to cause movement of the first roofing panel between the retracted position and the extended position. In another example, a method for deflecting precipitation comprises the steps of providing a first roofing panel biased by gravity and applying an electrostatic force to the first roofing panel to cause the first roofing panel to move between a retracted position and an extended position against the bias of gravity.

18 Claims, 4 Drawing Sheets

PRECIPITATION DEFLECTOR

FIELD

The present invention relates to a roofing apparatus and methods, and more particularly, to a roofing apparatus and methods for deflecting precipitation.

BACKGROUND

For outdoor sporting events, weather can have an impact on the event being played. For example, precipitation such as rain or snow can impair the playing conditions on the field and can also disturb spectators watching the sporting event. Sometimes, if the weather is severe enough, the sporting event may be delayed or cancelled. Thus, it would be beneficial to provide a roof over the field or spectators. A roof can protect the field or spectators from precipitation, lighting, or other elements of the weather and can also provide shade from the sun. However, when weather is ideal, it may be desired for the field or spectators to be exposed to the outside. Indeed, even when it is raining, it may be desired for the field to be exposed to the rain if the field comprises natural grass. Thus, there is a need for a retractable roofing apparatus that can be extended and retracted as desired to selectively provide a roof over the field or spectators.

SUMMARY

The following presents a simplified summary of the disclosure in order to provide a basic understanding of some example aspects described in the detailed description.

In a first aspect, a roofing apparatus for deflecting precipitation comprises a first roofing panel movable between a retracted position and an extended position. The roofing apparatus further comprises an electrostatic charging device configured to selectively apply an electrostatic force to the first roofing panel to cause movement of the first roofing panel between the retracted position and the extended position.

In one example of the first aspect, the roofing apparatus further comprises a first attracting member. The electrostatic charging device is configured to apply a first electrostatic charge to the first roofing panel and a second electrostatic charge to the first attracting member that is opposite the first electrostatic charge to at least partially produce the electrostatic force to cause movement of the first roofing panel from the refracted position to the extended position. A free end of the first roofing panel may be configured to move in a direction toward the first attracting member as the first roofing panel moves from the retracted position to the extended position. The first attracting member may comprise a plate. The plate may be substantially parallel with the first roofing panel when the first roofing panel is oriented in the refracted position.

In another example of the first aspect, the roofing apparatus further comprises a repelling member. The electrostatic charging device is configured to selectively apply a first electrostatic charge to the first roofing panel and a second electrostatic charge to the repelling member that is the same as the first electrostatic charge to at least partially produce the electrostatic force to cause movement of the first roofing panel from the retracted position to the extended position. The roofing apparatus may comprise a first attracting member and the electrostatic charging device may be configured to apply a third electrostatic charge to the first attracting member that is opposite the first electrostatic charge to at least partially produce the electrostatic force. Furthermore, a free end of the first roofing panel may be configured to move in a direction away from the repelling member and toward the first attracting member as the first roofing panel moves from the retracted position to the extended position.

In still another example of the first aspect, the roofing apparatus comprises a gutter configured to collect precipitation from the roofing panel when the roofing panel is in the extended position.

The first aspect may be carried out alone or with one or any combination of the examples of the first aspect discussed above.

In a second aspect, a roofing apparatus for deflecting precipitation comprises a first roofing panel and a second roofing panel that are each pivotally mounted with respect to a support member configured to support a weight of the roofing panels. Each roofing panel is pivotable between a retracted position and an extended position. The roofing apparatus further comprises an electrostatic charging device configured to selectively apply an electrostatic force to each of the roofing panels to cause rotation of each roofing panel from the refracted position to the extended position.

In one example of the second aspect, the roofing panels are configured to rotate in opposite directions when the roofing panels are rotated from the retracted position to the extended position.

In another example of the second aspect, the electrostatic charging device is configured to selectively apply the same charges to the first roofing panel and the second roofing panel to at least partially produce the electrostatic force. The roofing apparatus may comprise a repelling member and the electrostatic charging device may be configured to apply a charge to the repelling member that is the same as the charge applied to the first roofing panel and the second roofing panel.

In still another example of the second aspect, the roofing apparatus comprises a first attracting member. The electrostatic charging device is configured to apply a charge to the first attracting member that is opposite to the charge applied to the first roofing panel to at least partially produce the electrostatic force that causes rotation of the first roofing panel from the retracted position to the extended position. The roofing apparatus may comprise a second attracting member and the electrostatic charging device may be configured to apply a charge to the second attracting member that is opposite to the charge applied to the second roofing panel to at least partially produce the electrostatic force that causes rotation of the second roofing panel from the retracted position to the extended position.

In still yet another example of the second aspect, the roofing apparatus comprises a first gutter configured to collect precipitation from the first roofing panel when the first roofing panel is in the extended position and a second gutter configured to collect precipitation from the first roofing panel when the second roofing panel is in the extended position.

The second aspect may be carried out alone or with one or any combination of the examples of the second aspect discussed above.

In a third aspect a method for deflecting precipitation comprises the steps of providing a first roofing panel biased by gravity and applying an electrostatic force to the first roofing panel to cause the first roofing panel to move between a retracted position and an extended position against the bias of gravity.

In one example of the third aspect, the method comprises the step of applying the same electrostatic charge to the first roofing panel and a repelling member to at least partially produce the electrostatic force.

In another example of the third aspect, the method comprises the step of applying an electrostatic charge to the first roofing panel and an opposite electrostatic charge to a first attracting member to at least partially produce the electrostatic force.

In still another example of the third aspect, the method comprises the step of applying the same electrostatic charge to the first roofing panel and a repelling member and an opposite electrostatic charge to a first attracting member to at least partially produce the electrostatic force. The electrostatic force causes a free end of the first roofing panel to move in a direction away from the repelling member and toward the first attracting member.

The third aspect may be carried out alone or with one or any combination of the examples of the third aspect discussed above.

BRIEF DESCRIPTION OF THE DRAWINGS

These and other features, aspects and advantages of the present disclosure are better understood when the following detailed description is read with reference to the accompanying drawings, in which.

DETAILED DESCRIPTION

Figure 1A:
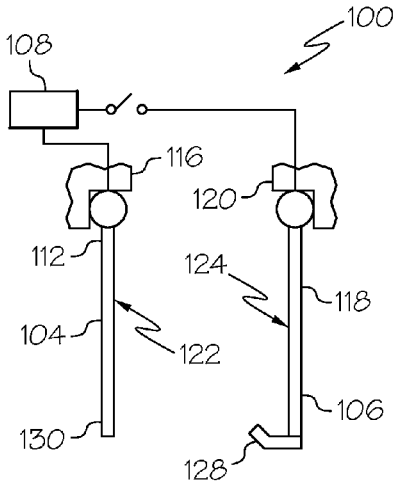
FIG. 1A schematically illustrates a first example embodiment of a roofing apparatus in a retracted position.

Apparatus and methods will now be described more fully hereinafter with reference to the accompanying drawings in which example embodiments of the disclosure are shown. Whenever possible, the same reference numerals are used throughout the drawings to refer to the same or like parts. However, this disclosure may be embodied in many different forms and should not be construed as limited to the embodiments set forth herein.

Figure 1B:
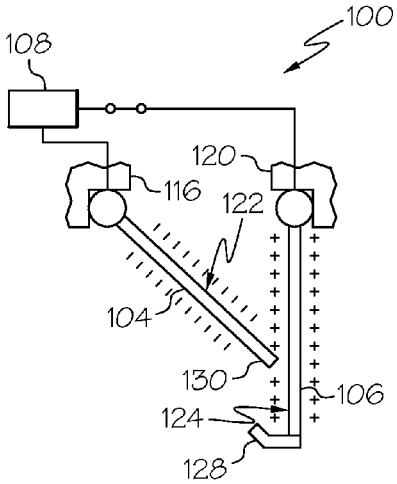
FIG. 1B schematically illustrates the first example embodiment of the roofing apparatus in an extended position.

Turning to FIGS. 1A & 1B, an example embodiment of a roofing apparatus 100 for deflecting precipitation is illustrated that comprises a first roofing panel 104, a first attracting member 106, and an electrostatic charger 108. A first end 112 of the first roofing panel 104 is pivotally mounted to a support member 116 such that the first roofing panel 104 is movable between a retracted position (as shown in FIG. 1A) and an extended position (as shown in FIG. 1B). In the illustrated example, the first attracting member 106 may be provided in a wide range of configurations that can carry an electrostatic charge. In just one example, the first attracting member 106 can comprise a plate 118 although the attracting member may comprise a rod, substrate or other member. In the illustrated example, the first attracting member 106 is shown suspended from a support member 120. For instance, the first attracting member 106 can be fixedly attached to the support member 120, although the first attracting member 106 may have a rotational attachment (e.g., a limited rotational movement) or other support arrangement with the support member 120. In the illustrated example, the first attracting member 106 is fixedly attached to the support ember 120 in a substantially vertical position such that the first attracting member 106 extends in the direction of gravity, although non-vertical orientations may be provided in further examples. Moreover, as shown, the first attracting member 106 may be suspended from above the support member 120 although the first attracting member 106 may be supported from below in further examples.

In the retracted position, the first roofing panel 104 can extend in a downward direction relative to gravity. For example, as illustrated, the first roofing panel 104 can extend vertically downward from the support member 116 in the direction of gravity. In such a vertically downward orientation, a surface 122 of the first roofing panel 104 may be substantially vertical and, in some examples, parallel with a surface 124 of the first attracting member 106. When oriented as such, a gap may be defined between first roofing panel 104 and the first attracting member 106 that permits precipitation, sunlight and air to pass freely through the open roofing apparatus. Referring to FIG. 1B, in the extended position, the gap may be narrowed with the surface 122 of the first roofing panel 104 arranged at a non-vertical angle such that precipitation and/or sunlight from above is at least partially blocked and/or deflected by the surface 122. As illustrated, the surface 122 can be arranged at a downward angle such that precipitation on the surface 122 of the first roofing panel 104 is deflected to be guided towards the first attracting member 106. Although not shown, in further examples, the surface 122 may be substantially horizontal or arranged at an angle that deflects precipitation toward another structure besides the first attracting member 106. Moreover, although a narrow gap is maintained in the present example when the first roofing panel 104 is in the extended position, there may be other embodiments wherein the first roofing panel 104 contacts the first attracting member 106 and the gap between is completely closed.

As apparent in FIG. 1B, precipitation deflected by the first roofing panel 104 in the extended position will either fall naturally through the narrowed gap or the precipitation will be further deflected downward by the surface 124 of the first attracting member 106. An optional gutter 128 may be provided vertically below the narrowed gap to collect the precipitation and guide the precipitation towards a drain for removal. Thus, when the first roofing panel 104 is in the extended position, precipitation falling between the first roofing panel 104 and the first attracting member 106 will be deflected towards the gutter 128 where it can be collected and removed. In addition or alternatively, the first roofing panel 104 can provide shade for the area below. Meanwhile, in the retracted position shown in FIG. 1A, precipitation and sunlight are allowed to pass between the first roofing panel 104 and the first attracting member 106 without such interference.

The first roofing panel 104 of the present example is naturally biased by gravity to the retracted position shown in FIG. 1A. The electrostatic charger 108 is configured to selectively apply an electrostatic force to the first roofing panel 104 to cause movement of the first roofing panel 104 from the retracted position of FIG. 1A to the extended position of FIG. 1B. In one example, the electrostatic charger 108 is configured to apply a first electrostatic charge to the first roofing panel 104 and a second electrostatic charge to the first attracting member 106 that is opposite the first electrostatic charge to produce the electrostatic force to cause movement of the first roofing panel 104 from the retracted position to the extended position. For example, as can be seen in FIG. 1B, the electrostatic charger 108 may optionally provide a negative charge to the first roofing panel 104 and a positive charge to the first attracting member 106. As a result of the opposite electrostatic charges applied to the roofing panel 104 and the first attracting member 106, an electrostatic force is produced that causes a free end 130 of the first roofing panel 104 to move in a direction toward the first attracting member 106 until the first roofing panel 104 reaches the extended position. However, the electrostatic charger 108 in other embodiments may apply a positive charge to the first roofing panel 104 and a negative charge to the first attracting member 106 to produce the same electrostatic force to cause movement of the first roofing panel 104 from the refracted position to the extended position. Once in the extended position, in one example, the electrostatic charger 108 may optionally continue to apply the electrostatic force to hold the first roofing panel 104 in the extended position. In another example, a locking mechanism (not shown) may be provided that releasably locks the first roofing panel 104 in the extended position so that the electrostatic charger 108 may discontinue applying the electrostatic force without the first roofing panel 104 returning to the refracted position. If the first roofing panel 104 is not locked in place and the electrostatic force is discontinued, however, the first roofing panel 104 will return to the retracted position shown in FIG. 1A.

Figure 2A:
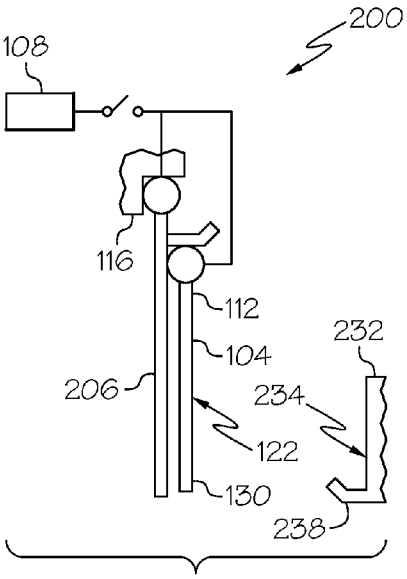
FIG. 2A schematically illustrates a second example embodiment of the roofing apparatus in a retracted position.
Figure 2B:
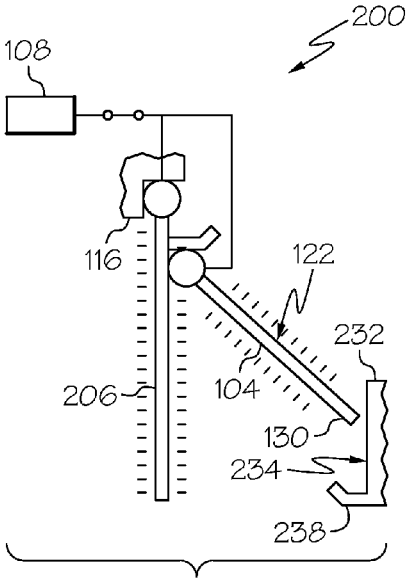
FIG. 2B schematically illustrates the second example embodiment of the roofing apparatus in an extended position.

Turning to FIGS. 2A & 2B, another embodiment of the roofing apparatus 200 is shown that does not include the first attracting member 106. In this embodiment, the roofing apparatus 200 comprises a repelling member 206 that, in one example, may be attached to the support member 116 to be suspended from the support member 116. Although not shown, the repelling member 206 may alternatively be supported from below such that the repelling member 206 extends upwardly. In some examples, the repelling member 206 may be fixedly attached to the support member 116, although the repelling member 206 may be pivotally attached in further examples. Moreover, as shown, the repelling member 206 may be oriented substantially vertically to extend in the direction of gravity, although other orientations may be provided in further examples. The first end 112 of the first roofing panel 104 may be pivotally mounted to the repelling member 206 such that the first roofing panel 104 is supported by the repelling member 206 and is movable between a retracted position (as shown in FIG. 2A) and an extended position (as shown in FIG. 2B). Therefore, the first roofing panel 104 may be indirectly supported by the support member 116 by being pivotally attached to the repelling member 206 that is in turn attached to the support member 116. Although not shown, in further examples, the first roofing panel 104 may be pivotally attached directly to the support member 116. For example, the repelling member 206 and the first roofing panel 104 may both be directly attached to the support member 116. Still further, both the first roofing panel 104 and the repelling member 206 may be supported from above, such that both the first roofing panel 104 and the repelling member 206 are suspended from the support member 116. In further examples, the repelling member 206 may be supported from below while the first roofing panel 104 is supported from above.

In the retracted position, in one example, the first roofing panel 104 extends vertically downward from the first end 112 such that the surface 122 of the first roofing panel 104 is substantially vertical to extend in the direction of gravity, although non-vertical orientations may be provided in further examples. In further examples, the first roofing panel 104 may further extend parallel with the repelling member 206. When oriented in the retracted position of FIG. 2A, a gap may be defined between first roofing panel 104 and a first offset member 232 that permits precipitation, sunlight and air to pass through the roofing apparatus 200. In the extended position of FIG. 2B, however, the gap may be narrowed with the surface 122 of the first roofing panel 104 arranged at a non-vertical angle such that precipitation and/or sunlight from above is at least partially blocked and/or deflected by the surface 122. In one example, the surface 122 is arranged at a downward angle so that as precipitation landing, condensing, or otherwise provided on the surface 122 of the first roofing panel 104 is deflected to be guided towards the first offset member 232. Although not shown, in further examples, the surface 122 may be substantially horizontal or arranged at an angle that deflects precipitation to be guided toward another structure besides the first offset member 232. Moreover, although a narrow gap is maintained in the present example when the first roofing panel 104 is in the extended position, there may be other embodiments wherein the first roofing panel 104 contacts the first offset member 232 and the gap between is completely closed.

In the present example shown in FIG. 2B, precipitation deflected by the first roofing panel 104 in the extended position will either fall naturally through the narrowed gap or the precipitation will be further deflected downward by a surface 234 of the first offset member 232. An optional gutter 238 may be provided vertically below the narrowed gap to collect the precipitation and guide the precipitation towards a drain for removal. Thus, when the first roofing panel 104 is in the extended position, precipitation falling between the first roofing panel 104 and the first offset member 232 will be deflected towards the gutter 238 where it can be collected and removed. In addition or alternatively, the first roofing panel 104 can provide shade for the area below. Meanwhile, in the retracted position shown in FIG. 2A, precipitation and sunlight are allowed to pass between the first roofing panel 104 and the first offset member 232 without such interference.

The first roofing panel 104 of the present example is also naturally biased by gravity to the refracted position shown in FIG. 2A. The electrostatic charger 108 is configured to selectively apply a first electrostatic charge to the first roofing panel 104 and a second electrostatic charge to the repelling member 206 that is the same as the first electrostatic charge to produce an electrostatic force to cause movement of the first roofing panel 104 from the retracted position of FIG. 2A to the extended position of FIG. 2B. For example, as can be seen in FIG. 2B, the electrostatic charger 108 may optionally provide negative charges to both the first roofing panel 104 and the first repelling member 206. As a result of the negative charges applied to both the first roofing panel 104 and the first repelling member 206, an electrostatic force is produced that causes the free end 130 of the first roofing panel 104 to move in a direction toward the first attracting member 106 until the first roofing panel reaches the extended position. However, the electrostatic charger 108 in other embodiments may apply positive charges to both the first roofing panel 104 and the first repelling member 206 to produce the same electrostatic force to cause movement of the first roofing panel 104 from the retracted position to the extended position. Once in the extended position, in one example, the electrostatic charger 108 may optionally continue to apply the electrostatic force to hold the first roofing panel 104 in the extended position. In another example, a locking mechanism (not shown) may be provided that releasably locks the first roofing panel 104 in the extended position so that the electrostatic charger 108 may discontinue applying the electrostatic force without the first roofing panel 104 returning to the retracted position.

The two embodiments described above illustrate how a single attracting member or repelling member may be used in conjunction with a roofing panel to generate an electrostatic force to move the roofing panel from a retracted position to an extended position. However, in further examples, a combination of attracting members and/or repelling members may be used to generate an electrostatic force to move a roofing panel from a retracted position to an extended position. Providing a combination of attracting members and/or repelling members may enhance the electrostatic force to help the roofing panel(s) reach the fully extended position. For example, turning to FIGS. 3A & 3B, another embodiment of the roofing apparatus 300 is shown that comprises the first roofing panel 104, the first attracting member 106, and the repelling member 206 described above. In addition, the roofing apparatus 300 can optionally comprise a second roofing panel 304 and a second attracting member 306. The repelling member 206 and the second attracting member 306 can be respectively fixed to a support member 316 and a support member 320 in a substantially vertical position such that repelling member 206 and the second attracting member 306 extend in the direction of gravity, although non-vertical orientations may be provided in further examples. The first end 112 of the first roofing panel 104 and a first end 312 of the second roofing panel 304 can be pivotally mounted to the repelling member 206 such that the first roofing panel 104 and the second roofing panel 304 are each movable between a retracted position (as shown in FIG. 3A) and an extended position (as shown in FIG. 3B).

When the first roofing panel 104 is in the retracted position, the first roofing panel 104 can extend in a downward direction relative to gravity. For example, as illustrated, the first roofing panel 104 can extend vertically downward from the fixed end 112 in the direction of gravity. In such a vertically downward orientation, the surface 122 of the first roofing panel 104 may be substantially vertical and, in some examples, parallel with the repelling member 206 and the surface 124 of the first attracting member 106. Similarly, when the second roofing panel 304 is in the refracted position, the second roofing panel 304 can extend in a downward direction relative to gravity. For example, as illustrated, the second roofing panel 304 can extend vertically downward from the fixed end 312 such that a surface 322 of the second roofing panel 304 is substantially vertical and parallel with the repelling member 206 and a surface 324 of the second attracting member 306. Thus, a first gap may be defined between the first roofing panel 104 and the first attracting member 106 and a second gap may be defined between second roofing panel 304 and the second attracting member 306 that permit precipitation, sunlight, and air to pass freely through the open roofing apparatus 300. In the extended position, however, the first and second gaps may be narrowed with the surfaces 122 and 322 of the first and second roofing panels 104, 304 arranged at non-vertical angles such that precipitation and/or sunlight from above are at least partially blocked and/or deflected by the surfaces 122 and 322.

Figure 3A:
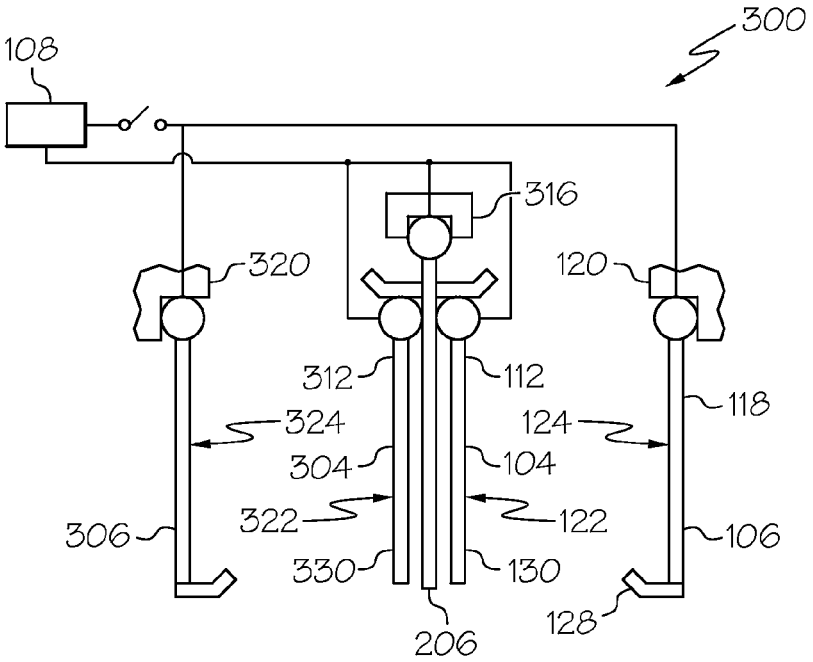
FIG. 3A schematically illustrates a third example embodiment of the roofing apparatus in a retracted position.
Figure 3B:
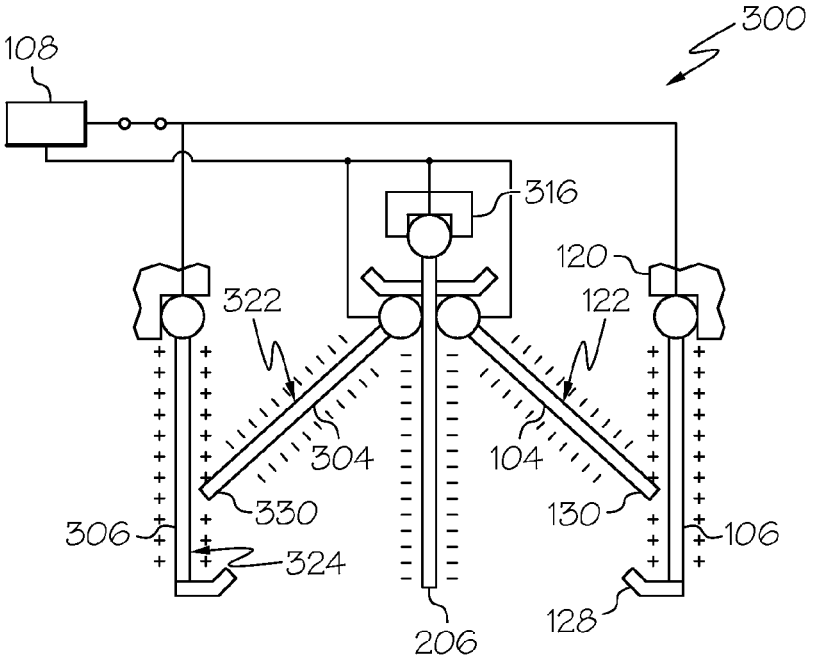
FIG. 3B schematically illustrates the third example embodiment of the roofing apparatus in an extended position.

The first roofing panel 104 and the second roofing panel 304 of the present example are naturally biased by gravity to their retracted position shown in FIG. 3A. The electrostatic charger 108 is configured to selectively apply electrostatic forces to the first and second roofing panels 104, 304 to cause movement of the first and second roofing panels 104, 304 from their retracted position of FIG. 3A to their extended position of FIG. 3B. For example, to apply an electrostatic force to the first roofing panel 104 and cause movement of the first roofing panel 104 to the extended position, the electrostatic charger 108 can optionally apply a first electrostatic charge to the first roofing panel 104 and a second electrostatic charge to the repelling member 206 that is the same as the first electrostatic charge to at least partially produce the electrostatic force. Additionally, the electrostatic charger 108 can optionally apply a third electrostatic charge to the first attracting member 106 that is opposite to the first electrostatic charge to at least partially produce the electrostatic force. The first and second charges may be positive while the third charge is negative or the first and second charges may be negative while the third charge is positive. As a result of these charges, an electrostatic force will be applied to the first roofing panel 104 that repels the first roofing panel 104 away from the repelling member 206 and attracts the first roofing panel 104 to the first attracting member 106, thus causing the free end 130 of the first roofing panel 104 to move in a direction toward the first attracting member 106 until the first roofing panel 104 reaches the extended position.

As another example, to apply an electrostatic force to the second roofing panel 304 and cause movement of the second roofing panel 304 to the extended position, the electrostatic charger 108 can optionally apply a first electrostatic charge to the second roofing panel 104 and a second electrostatic charge to the repelling member 206 that is the same as the first electrostatic charge to at least partially produce the electrostatic force. Additionally, the electrostatic charger 108 can optionally apply third electrostatic charge to the second attracting member 306 that is opposite to the first electrostatic charge to at least partially produce the electrostatic force. The first and second charges may be positive while the third charge is negative or the first and second charges may be negative while the third charge is positive. As a result of these charges, an electrostatic force will be applied to the second roofing panel 304 that repels the second roofing panel 304 away from the repelling member 206 and attracts the second roofing panel 304 to the second attracting member 306, thus causing the free end 330 of the second roofing panel 304 to move in a direction toward the second attracting member 306 until the second roofing panel 304 reaches the extended position.

As yet another example, to apply electrostatic forces to both the first and second roofing panels 104, 304 and cause movement of both the first and second roofing panels 104, 304 to their extended position, the electrostatic charger 108 can optionally apply electrostatic charges to the first roofing panel 104, the second roofing panel 304, and the repelling member 206 that are all the same to at least partially produce the electrostatic forces. Additionally, the electrostatic charger 108 can optionally apply electrostatic charges to the first attracting member 106 and the second attracting member 306 that are both opposite to the charges applied to the first roofing panel 104, the second roofing panel 304, and the repelling member 206 to at least partially produce the electrostatic force. The charges applied to the first roofing panel 104, the second roofing panel 304, and the repelling member 206 may all be negative while the charges applied to the first attracting member 106 and the second attracting member 306 are both positive or the charges applied to the first roofing panel 104, the second roofing panel 304, and the repelling member 206 may all be positive while the charges applied to the first attracting member 106 and the second attracting member 306 are both negative. As a result of these charges, a first electrostatic force will be applied to the first roofing panel 104 that repels the first roofing panel 104 away from the repelling member 206 and second roofing panel 304 and attracts the first roofing panel 104 to the first attracting member 106, thus causing the free end 130 of the first roofing panel 104 to move in a direction toward the first attracting member 106 until the first roofing panel 104 reaches the extended position. Moreover, a second electrostatic force will be applied to the second roofing panel 304 that repels the second roofing panel 304 away from the repelling member 206 and first roofing panel 104 and attracts the second roofing panel 304 to the second attracting member 306, thus causing the free end 330 of the second roofing panel 304 to move in a direction toward the second attracting member 306 until the second roofing panel 304 reaches the extended position.

Figure 4A:
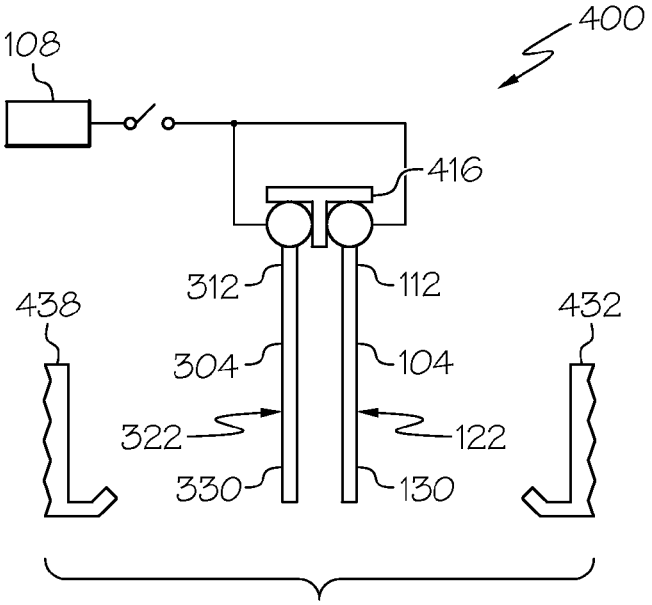
FIG. 4A schematically illustrates a fourth example embodiment of the roofing apparatus in a retracted position.
Figure 4B:
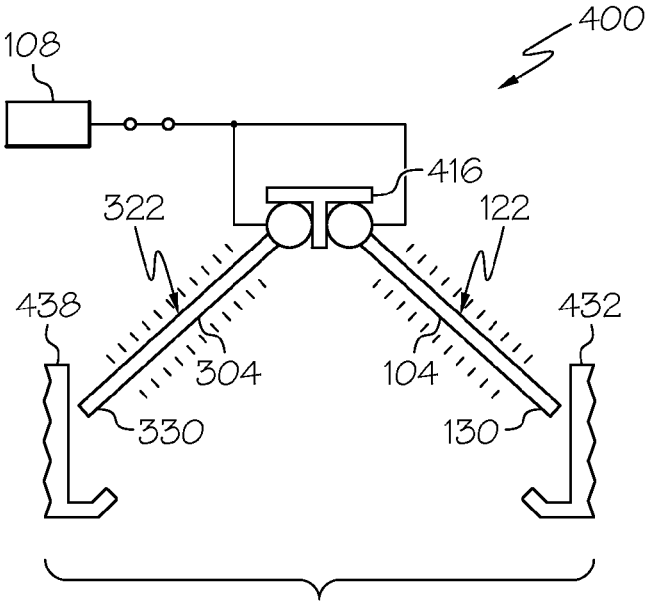
FIG. 4B schematically illustrates the fourth example embodiment of the roofing apparatus in an extended position.

Turning now to FIGS. 4A & 4B, another embodiment of the roofing apparatus 400 is shown that comprises the first roofing panel 104 and the second roofing panel 306 but does not include any of the other attracting or repelling members described above. In this embodiment, the first end 112 of the first roofing panel 104 and a first end 312 of the second roofing panel 304 are pivotally mounted to a support member 416 such that the first roofing panel 104 and the second roofing panel 304 are each movable between a retracted position (as shown in FIG. 4A) and an extended position (as shown in FIG. 4B).

When the first and second roofing panels 104, 304 are in the refracted position, the first and second roofing panels 104, 304 can extend in a downward direction relative to gravity. For example, as illustrated, the first and second roofing panels 104, 304 can extend vertically downward from their fixed ends 112, 312. In such a vertically downward orientation, the surface 122 of the first roofing panel 104 may be substantially vertical and, in some examples, parallel with the surface 322 of the second roofing panel 304. A first gap may be defined between the first roofing panel 104 and a first offset member 432 and a second gap may be defined between second roofing panel 304 and a second offset member 438 that permit precipitation, sunlight and air to pass freely through the open roofing apparatus 400. Referring to FIG. 4B, in the extended position, the first and second gaps may be narrowed with the surfaces 122 and 322 of first and second roofing panels 104, 304 arranged at non-vertical angles such that precipitation and/or sunlight from above is at least partially blocked and/or deflected by the surfaces 122 and 322.

The first roofing panel 104 and the second roofing panel 304 of the present example are naturally biased by gravity to their retracted position shown in FIG. 4A. The electrostatic charger 108 is configured to selectively apply electrostatic forces to the first and second roofing panels 104, 304 to cause movement of the first and second roofing panels 104, 304 from their refracted position to their extended position. For example, the electrostatic charger 108 is configured to optionally apply a first electrostatic charge to the first roofing panel 104 and a second electrostatic charge to the second roofing panel 304 that is the same as the first electrostatic charge to produce the electrostatic forces. The charges may both be negative or the charges may both be positive. As a result of these charges, a first electrostatic force will be applied to the first roofing panel 104 that repels the first roofing panel 104 away from the second roofing panel 304, thus causing the free end 130 of the first roofing panel 104 to move in a direction toward the first offset member 432 until the first roofing panel 104 reaches the extended position. Moreover, a second electrostatic force will be applied to the second roofing panel 304 that repels the second roofing panel 304 away from the first roofing panel 104, thus causing the free end 330 of the second roofing panel 304 to move in a direction toward the second offset member 438 until the second roofing panel 304 reaches the extended position. In this manner, both the first and second roofing panels 104, 304 act as repelling members against each other.

Figure 5A:
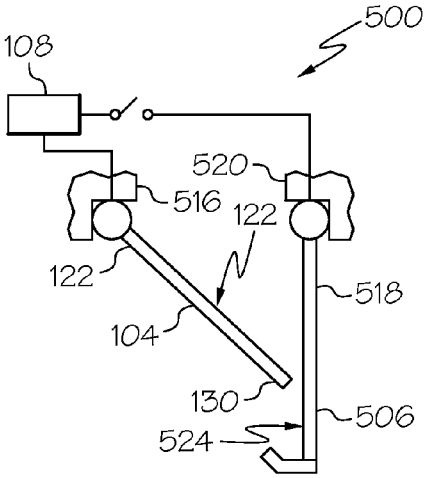
FIG. 5A schematically illustrates a fifth example embodiment of the roofing apparatus in an extended position.
Figure 5B:
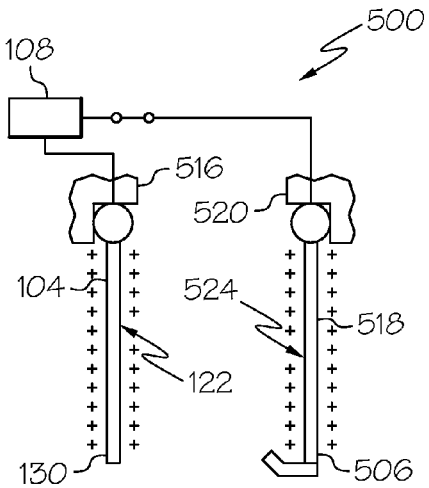
FIG. 5B schematically illustrates the fifth example embodiment of the roofing apparatus in a retracted position.

The embodiments described above illustrate various combinations of attracting members, repelling members, and roofing panels that may be provided to generate an electrostatic force on a roofing panel to move the roofing panel from a refracted position to an extended position. However, similar combinations may be provided to generate an electrostatic force on a roofing panel to move the roofing panel from an extended position to a retracted position. For example, turning to FIGS. 5A & 5B, an embodiment of the roofing apparatus 500 is shown that comprises the first roofing panel 104 and a repelling member 506. The first end 112 of the first roofing panel 104 can be pivotally mounted to a support member 516 such that the first roofing panel 104 is movable between an extended position (as shown in FIG. 5A) and a retracted position (as shown in FIG. 5B). Meanwhile, a plate 518 of the repelling member 506 can be fixed to a support member 520 in a substantially vertical position such that the repelling member 506 extends in the direction of gravity, although non-vertical orientations may be provided in further examples.

In the retracted position, the first roofing panel 104 can extend in a downward direction relative to gravity. For example, as illustrated, the first roofing panel 104 can extend vertically downward from the support member 516 in the direction of gravity. In such a vertically downward orientation, the surface 122 of the first roofing panel 104 may be substantially vertical and, in some examples, parallel with a surface 524 of the repelling member 506. When oriented as such, a gap may be defined between first roofing panel 104 and the repelling member 506 that permits precipitation, sunlight, and air to pass freely through the open roofing apparatus 500. In the extended position, the gap may be narrowed with the surface 122 of the first roofing panel 104 arranged at a non-vertical angle such that precipitation and/or sunlight from above is at least partially blocked and/or deflected by the surface 122.

The first roofing panel 104 of the present embodiment is biased to the extended position. The bias may be provided by a spring or other biasing means. Since the first roofing panel 104 is biased toward the extended position, the electrostatic charger 108 may be configured to selectively apply an electrostatic force to the first roofing panel 104 to cause movement of the first roofing panel 104 from the extended position to the retracted position. For example, the electrostatic charger 108 can optionally apply a first electrostatic charge to the first roofing panel 104 and a second electrostatic charge to the repelling member 506 that is the same as the first electrostatic charge to produce the electrostatic force to cause movement of the first roofing panel 104 from the extended position to the retracted position. The charges may both be positive or the charges may both be negative to produce the same motion. As a result of the charges, an electrostatic force will be applied to the first roofing panel 104 that repels the first roofing panel 104 away from the repelling member 506, thus causing the free end 130 of the first roofing panel 104 to move in a direction away from the repelling member 506 until the first roofing panel 104 reaches the retracted position. Once in the extended position, in one example, the electrostatic charger 108 may optionally continue to apply the electrostatic force to hold the first roofing panel 104 in the retracted position. In another example, a locking mechanism (not shown)

may be provided that releasably locks the first roofing panel 104 in the retracted position so that the electrostatic charger 108 may discontinue applying the electrostatic force without the first roofing panel 104 returning to the extended position. If the first roofing panel 104 is not locked in place and the electrostatic force is discontinued, however, the first roofing panel 104 will return to the extended position shown in FIG. 5A.

The attracting members, repelling members, and roofing panels described above may comprise aluminum to permit them to be electrostatically charged while maintaining a light weight. However, the attracting members, repelling members, and roofing panels may comprise any material that permits them to be electrostatically charged. Moreover, the attracting members, repelling members, and roofing panels may take on a variety of other shapes and configurations without departing from the scope of the invention. For example, the attracting members and repelling members may comprise electrostatically charged rods or wire as opposed to an electrostatically charged plate. Furthermore, although the roofing panels described above all rotate between an extended and retracted position, other motions such as, for example, sliding may be performed to move the roofing panels between an extended and retracted position. Still further, the roofing apparatus may comprise any number of roofing panels, attracting members, and repelling members.

Figure 6:
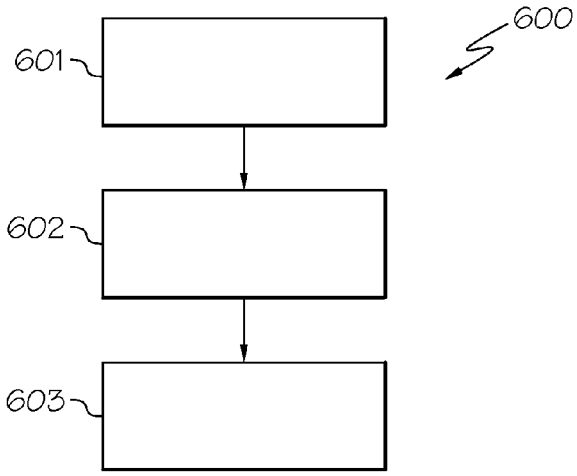
FIG. 6 is a flow chart illustrating steps of a method for deflecting precipitation.

Turning now to FIG. 6, an example method 600 will now be described for deflecting precipitation. The method may comprise the step 601 of providing a first roofing panel biased by gravity. The first roofing panel may be movable between a refracted position and an extended position and biased by gravity towards one of the positions. The method may further comprise the step 602 of providing a first attracting member and/or a repelling member. The first roofing panel, the first attracting member, and the repelling member may be configured and arranged, for example, according to one of the embodiments of the roofing apparatus 100 described above. The method can further include the step 603 of applying an electrostatic force to the first roofing panel to cause the first roofing panel to move between the refracted position and extended position against the bias of gravity. To apply the electrostatic force, the same electrostatic charge may be applied to the first roofing panel and the repelling member to at least partially produce the electrostatic force. In addition to or alternatively, an electrostatic charge may be applied to the first roofing panel and an opposite electrostatic charge may be applied to the first attracting member to at least partially produce the electrostatic force. The electrostatic charges and resultant electrostatic force may be applied by an electrostatic charger. For example, the electrostatic charges and resultant electrostatic force may be applied by the electrostatic charger 108 described above. The resultant electrostatic force created by the charges will cause a free end of the first roofing panel to move in a direction away from the repelling member and/or toward the first attracting member.

The apparatus and method described above can be useful for protecting an outdoor sporting event from the weather. When it is desired to shield the event from precipitation or other weather, the roofing panel(s) may be moved to the extended position (e.g., by applying the electrostatic force as shown in FIGS. 1A, 1B, 2A, 2B, 3A, 3B, 4A, 4B, or by removing the electrostatic force as shown in FIGS. 5A, 5B). Alternatively, when it is desired to expose the event to the outdoors, the roofing panel(s) may be moved to the retracted position (e.g., by removing the electrostatic force as shown in FIGS. 1A, 1B, 2A, 2B, 3A, 3B, 4A, 4B, or by applying the electrostatic force as shown in FIGS. 5A, 5B). Thus, the apparatus and method described above provide a retractable roofing apparatus that can be extended and retracted as desired to selectively provide a roof over a sporting event. Moreover, because water is polar, rain drops will be attracted to any electrostatically charged members of the roofing apparatus, thus enhancing their ability to control and deflect the rain drops toward structure for removing the rain drops, such as a gutter system. Furthermore, the roofing apparatus and method described above may be used for other purposes besides sporting events. The roofing apparatus and method described above may be used to provide a roof over any area where it is be desired to periodically expose the area to the outdoors.

It will be apparent to those skilled in the art that various modifications and variations can be made to the present disclosure without departing from the spirit and scope of the invention. Thus, it is intended that the present invention cover the modifications and variations of this disclosure provided they come within the scope of the appended claims and their equivalents.

What is claimed is:

1. A roofing apparatus for deflecting precipitation comprising:

a first roofing panel movable between a retracted position and an extended position, wherein the first roofing panel is configured to deflect precipitation in the extended position;

a first attracting member; and an electrostatic charging device configured to selectively apply an electrostatic force to the first roofing panel to cause movement of the first roofing panel between the retracted position and the extended position, wherein the electrostatic charging device is configured to apply a first electrostatic charge to the first roofing panel and a second electrostatic charge to the first attracting member that is opposite the first electrostatic charge to at least partially produce the electrostatic force to cause movement of the first roofing panel from the retracted position to the extended position.

2. The roofing apparatus of claim 1, wherein a free end of the first roofing panel is configured to move in a direction toward the first attracting member as the first roofing panel moves from the retracted position to the extended position.

3. The roofing apparatus of claim 1, wherein the first attracting member comprises a plate.

4. The roofing apparatus of claim 3, wherein the plate is substantially parallel with the first roofing panel when the first roofing panel is oriented in the retracted position.

5. A roofing apparatus for deflecting precipitation comprising:

a first roofing panel movable between a retracted position and an extended position, wherein the first roofing panel is configured to deflect precipitation in the extended position;

a repelling member; and an electrostatic charging device configured to selectively apply an electrostatic force to the first roofing panel to cause movement of the first roofing panel between the retracted position and the extended position, wherein the electrostatic charging device is configured to selectively apply a first electrostatic charge to the first roofing panel and a second electrostatic charge to the repelling member that is the same as the first electrostatic charge to at least partially produce the electrostatic force to cause movement of the first roofing panel from the refracted position to the extended position.

6. The roofing apparatus of claim 5, further comprising a first attracting member, wherein the electrostatic charging device is configured to apply a third electrostatic charge to the first attracting member that is opposite the first electrostatic charge to at least partially produce the electrostatic force.

7. The roofing apparatus of claim 6, wherein a free end of the first roofing panel is configured to move in a direction away from the repelling member and toward the first attracting member as the first roofing panel moves from the retracted position to the extended position.

8. The roofing apparatus of claim 1, further comprising a gutter configured to collect precipitation from the roofing panel when the roofing panel is in the extended position.

9. A roofing apparatus for deflecting precipitation comprising:

a first roofing panel and a second roofing panel that are each pivotally mounted with respect to a support member configured to support a weight of the roofing panels, wherein each roofing panel is pivotable between a retracted position and an extended position; and an electrostatic charging device configured to selectively apply an electrostatic force to each of the roofing panels to cause rotation of each roofing panel from the retracted position to the extended position, wherein the roofing panels are configured to rotate in opposite directions when the roofing panels are rotated from the retracted position to the extended position.

10. The roofing apparatus of claim 9, wherein the electrostatic charging device is configured to selectively apply the same charges to the first roofing panel and the second roofing panel to at least partially produce the electrostatic force.

11. The roofing apparatus of claim 10, further comprising a repelling member, wherein the electrostatic charging device is further configured to apply a charge to the repelling member that is the same as the charge applied to the first roofing panel and the second roofing panel.

12. The roofing apparatus of claim 9, further comprising a first attracting member, wherein the electrostatic charging device is configured to apply a charge to the first attracting member that is opposite to the charge applied to the first roofing panel to at least partially produce the electrostatic force that causes rotation of the first roofing panel from the retracted position to the extended position.

13. The roofing apparatus of claim 12, further comprising a second attracting member, wherein the electrostatic charging device is configured to apply a charge to the second attracting member that is opposite to the charge applied to the second roofing panel to at least partially produce the electrostatic force that causes rotation of the second roofing panel from the retracted position to the extended position.

14. The roofing apparatus of claim 9, further comprising a first gutter configured to collect precipitation from the first roofing panel when the first roofing panel is in the extended position and a second gutter configured to collect precipitation from the first roofing panel when the second roofing panel is in the extended position.

15. A method for deflecting precipitation comprising the steps of:

providing a first roofing panel biased by gravity;

applying an electrostatic force to the first roofing panel to cause the first roofing panel to move from a retracted position to an extended position against the bias of gravity; and deflecting precipitation with the first roofing panel while the first roofing panel is in the extended position.

16. The method of claim 15, further comprising the step of applying the same electrostatic charge to the first roofing panel and a repelling member to at least partially produce the electrostatic force.

17. The method of claim 15, further comprising the step of applying an electrostatic charge to the first roofing panel and an opposite electrostatic charge to a first attracting member to at least partially produce the electrostatic force.

18. The method of claim 15, further comprising the step of applying the same electrostatic charge to the first roofing panel and a repelling member and an opposite electrostatic charge to a first attracting member to at least partially produce the electrostatic force, wherein the electrostatic force causes a free end of the first roofing panel to move in a direction away from the repelling member and toward the first attracting member.

* * * * *